US011333999B2

(12) United States Patent
Furukawa et al.

(10) Patent No.: US 11,333,999 B2
(45) Date of Patent: May 17, 2022

(54) TONER CARTRIDGE INCLUDING SHUTTER ROTATABLE BETWEEN FIRST POSITION AND SECOND POSITION

(71) Applicant: BROTHER KOGYO KABUSHIKI KAISHA, Nagoya (JP)

(72) Inventors: Masaaki Furukawa, Nagoya (JP); Kazuma Hinoue, Nagoya (JP); Ryosuke Hayashi, Nagoya (JP); Naoya Kamimura, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/158,381

(22) Filed: Jan. 26, 2021

(65) Prior Publication Data

US 2021/0149325 A1 May 20, 2021

Related U.S. Application Data

(63) Continuation of application No. 16/901,133, filed on Jun. 15, 2020, now Pat. No. 10,908,533, which is a (Continued)

(30) Foreign Application Priority Data

Sep. 27, 2018 (JP) ..... JP2018-181798

(51) Int. Cl.
*G03G 15/08* (2006.01)

(52) U.S. Cl.
CPC ..... *G03G 15/0886* (2013.01); *G03G 15/0868* (2013.01); *G03G 2215/0692* (2013.01); *G03G 2215/0827* (2013.01)

(58) Field of Classification Search
CPC ..... G03G 15/0886; G03G 15/0868; G03G 2215/0692; G03G 2215/0827; G03G 15/0889; G03G 15/0891
See application file for complete search history.

(56) References Cited

U.S. PATENT DOCUMENTS 5,576,816 A 11/1996 Staudt et al.
5,740,506 A 4/1998 Sundquist et al.
(Continued)

FOREIGN PATENT DOCUMENTS

CN 1470954 A 1/2004
CN 1510533 A 7/2004
(Continued)

OTHER PUBLICATIONS

Office Action issued in corresponding Chinese Patent Application No. 201910904145.7 dated Nov. 1, 2021.
(Continued)

*Primary Examiner* — G. M. A Hyder
(74) *Attorney, Agent, or Firm* — Merchant & Gould P.C.

(57) ABSTRACT

A toner cartridge includes a first casing, a second casing, an auger screw, and a shutter. The first casing has a first internal space. The second casing has: a second internal space smaller than the first internal space; a first opening allowing toner in the second internal space to be discharged; and a second opening allowing air in the second internal space to be sent to an outside. The auger screw is rotatable about a first rotation axis and configured to convey toner in the first internal space to the second internal space. The shutter is rotatable relative to the second casing about a second rotation axis between a first position in which the shutter closes the first opening and a second position in which the shutter opens the first opening. In a state where the shutter is at the second position, the shutter does not close the second opening.

9 Claims, 9 Drawing Sheets

Related U.S. Application Data continuation of application No. 16/559,960, filed on Sep. 4, 2019, now Pat. No. 10,705,455.

(56) References Cited

U.S. PATENT DOCUMENTS

| | | | |
|---|---|---|---|
| 5,887,227 | A | 3/1999 | Kawai et al. |
| 8,019,235 | B2 | 9/2011 | Kaiho |
| 9,354,595 | B2 | 5/2016 | Tsuchiya |
| 10,126,681 | B2 | 11/2018 | Nishiyama |
| 2001/0021326 | A1 | 9/2001 | Yanagisawa et al. |
| 2002/0090226 | A1 | 7/2002 | Sato et al. |
| 2004/0134560 | A1 | 7/2004 | Sato et al. |
| 2007/0025774 | A1 | 2/2007 | Leute |
| 2007/0122205 | A1 | 5/2007 | Taguchi et al. |
| 2008/0080904 | A1 | 4/2008 | Murayama et al. |
| 2009/0035024 | A1 | 2/2009 | Sato |
| 2011/0064482 | A1 | 3/2011 | Ishiguro et al. |
| 2011/0103827 | A1 | 5/2011 | Uneme et al. |
| 2013/0101318 | A1 | 4/2013 | Shimizu et al. |
| 2013/0170863 | A1 | 7/2013 | Leemhuis et al. |
| 2014/0270868 | A1 | 9/2014 | Chiyoda et al. |
| 2014/0334850 | A1 | 11/2014 | Mitsuhashi |
| 2017/0285528 | A1 | 10/2017 | Nishiyama et al. |
| 2017/0285529 | A1 | 10/2017 | Nishiyama |
| 2017/0285530 | A1 | 10/2017 | Nishiyama et al. |
| 2018/0059576 | A1 | 3/2018 | Nishiyama |

FOREIGN PATENT DOCUMENTS

| | | | |
|---|---|---|---|
| CN | 102053529 | A | 5/2011 |
| CN | 104142615 | A | 11/2014 |
| EP | 3316042 | A1 | 5/2018 |
| JP | 2007-102065 | A | 4/2007 |
| JP | 2014-178661 | A | 9/2014 |
| JP | 2017-182009 | A | 10/2017 |
| JP | 6206530 | B2 | 10/2017 |
| RU | 2014 109 345 | A | 9/2015 |

OTHER PUBLICATIONS

Office Action issued in related Chinese Application No. 201910904145.7, dated Mar. 22, 2022.

TONER CARTRIDGE INCLUDING SHUTTER ROTATABLE BETWEEN FIRST POSITION AND SECOND POSITION

CROSS REFERENCE TO RELATED APPLICATION

This application is a continuation of U.S. patent application Ser. No. 16/901,133, filed Jun. 15, 2020, which is a continuation of U.S. patent application Ser. No. 16/559,960, filed Sep. 4, 2019, which claims priority from Japanese Patent Application No. 2018-181798 filed Sep. 27, 2018. The entire contents of the aforementioned applications are incorporated herein by reference.

TECHNICAL FIELD

The present disclosure relates to a toner cartridge configured to supply toner to a developing unit.

BACKGROUND

There is conventionally known a toner cartridge attachable to a developing unit including a developing roller. The toner cartridge has a toner discharge opening and includes an auger configured to convey toner accommodated in the toner cartridge toward the toner discharge opening. In a state where the toner cartridge is attached to the developing unit, the toner is supplied from the toner cartridge to the developing unit through the toner discharge opening.

SUMMARY

When the developing roller rotates, air is drawn into the developing unit and thus inner pressure of the developing unit may increase. Accordingly, when the developing unit to which the conventional toner cartridge operates in a long time, difference in inner pressure between the toner cartridge and the developing unit may occur. This may impede smooth discharge of the toner from the toner cartridge to the developing unit through the toner discharge opening.

In view of the foregoing, it is an object of the disclosure to provide a toner cartridge capable of smoothly discharging toner through the toner discharge opening.

In order to attain the above and other objects, according to one aspect, the disclosure provides a toner cartridge includes a first casing, a second casing, an auger screw, and a shutter. The first casing extends in an extending direction and has a first internal space capable of accommodating toner. The second casing is positioned at one end portion of the first casing in the extending direction and has a second internal space and a first opening. The second internal space is smaller than the first internal space and is connected to the first internal space. The first opening allows toner in the second internal space to be discharged. The auger screw is configured to convey toner in the first internal space to the second internal space. The auger screw is rotatable about a first rotation axis extending in the extending direction. The auger screw extends from the first internal space to the second internal space. The shutter is positioned at the one end portion of the first casing in the extending direction. The shutter is rotatable relative to the second casing about a second rotation axis between a first position in which the shutter closes the first opening and a second position in which the shutter opens the first opening. The second rotation axis extends in the extending direction. The second casing further has a second opening allowing air in the second internal space to be sent to an outside of the second casing. In a state where the shutter is at the second position, the shutter does not close the second opening.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
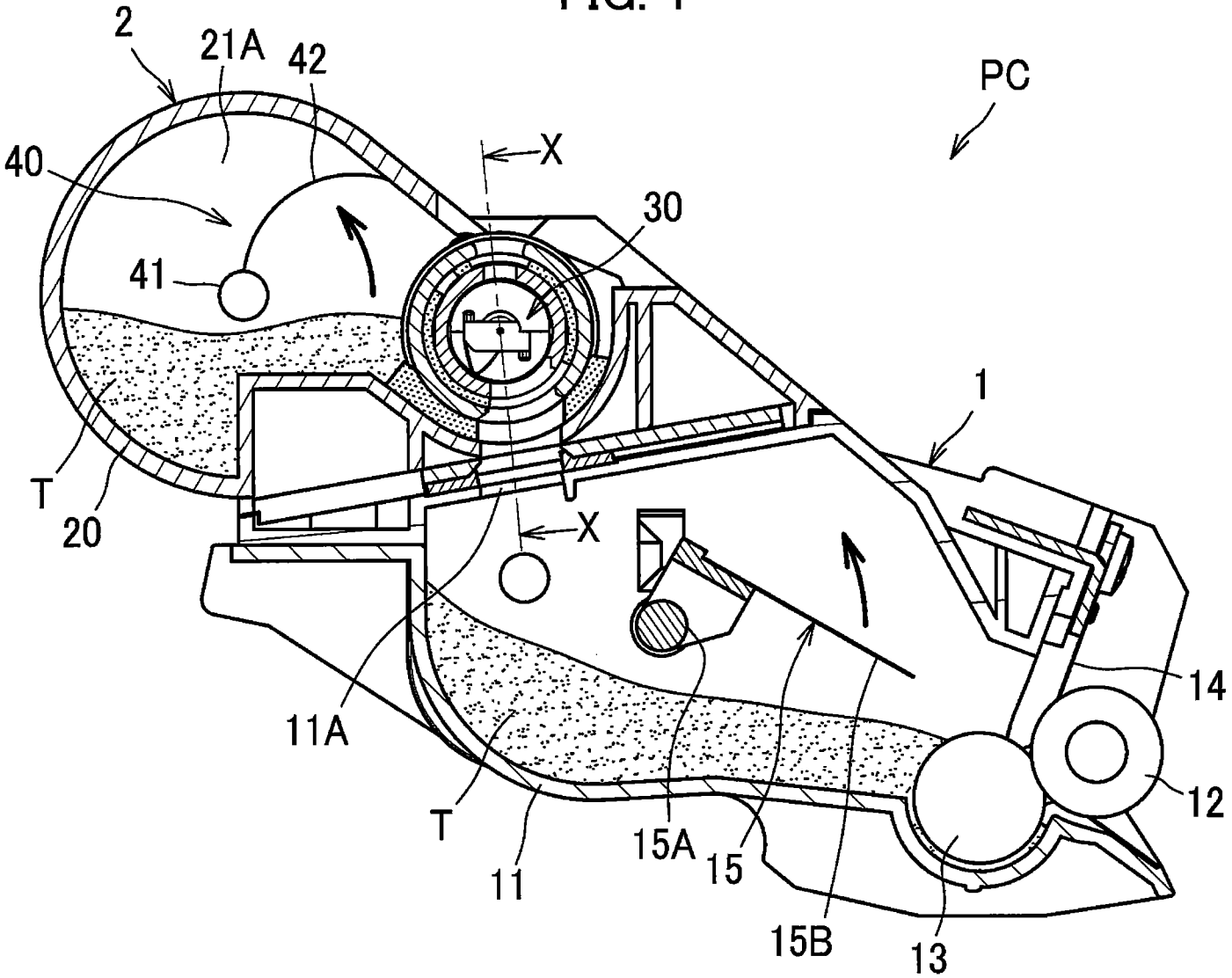
FIG. 1 is a cross-sectional view of a toner cartridge according to a first embodiment and a developing unit to which the toner cartridge is attached.

A toner cartridge 2 according to a first embodiment will be described in detail while referring to FIGS. 1 to 5. FIG. 1 illustrates a process cartridge PC for use with an image forming apparatus such as a printer. As illustrated in FIG. 1, the process cartridge PC includes a developing unit 1 and the toner cartridge 2 according to the first embodiment. For example, the developing unit 1 is a developing cartridge. The toner cartridge 2 is attached to the developing unit 1.

The developing unit 1 includes a casing 11, a developing roller 12, a supply roller 13, a layer thickness regulation blade 14, and an agitator 15.

The casing 11 can accommodate therein toner T. The casing 11 has a supply opening 11A. The supply opening 11A is positioned at a position facing a toner discharge opening 24 (a first opening 112) of the toner cartridge 2. The toner discharge opening 24 and the first opening 112 will be described later. The toner T is supplied from the toner cartridge 2 to the developing unit 1 through the supply opening 11A. The casing 11 rotatably supports the developing roller 12, the supply roller 13, and the agitator 15.

The developing roller 12 is configured to contact a photosensitive drum (not illustrated). The developing roller 12 is configured to supply the toner T to the photosensitive drum.

The supply roller 13 has a peripheral surface in contact with a peripheral surface of the developing roller 12. The supply roller 13 is a roller for supplying the toner T to the developing roller 12.

The layer thickness regulation blade 14 is supported by the casing 11. The tip end portion of the layer thickness regulation blade 14 is in contact with the peripheral surface of the developing roller 12. The layer thickness regulation blade 14 is configured to regulate the thickness of a toner layer formed on the developing roller 12.

The agitator 15 includes a shaft 15A and a blade 15B. The shaft 15A extends in an axial direction which is along a rotation axis of the developing roller 12.

The blade 15B is attached to the shaft 15. Hence, the blade 15B is rotatable together with the shaft 15A and can agitate the toner T accommodated in the casing 11. The blade 15B has a tip end portion which can contact an inner surface of the casing 11 during rotation of the blade 15B together with the shaft 15A.

The toner cartridge 2 is attachable to the developing unit 1. The toner cartridge 2 includes a casing 20, an auger screw 30, and a first agitator 40.

Figures 2A, 2B:
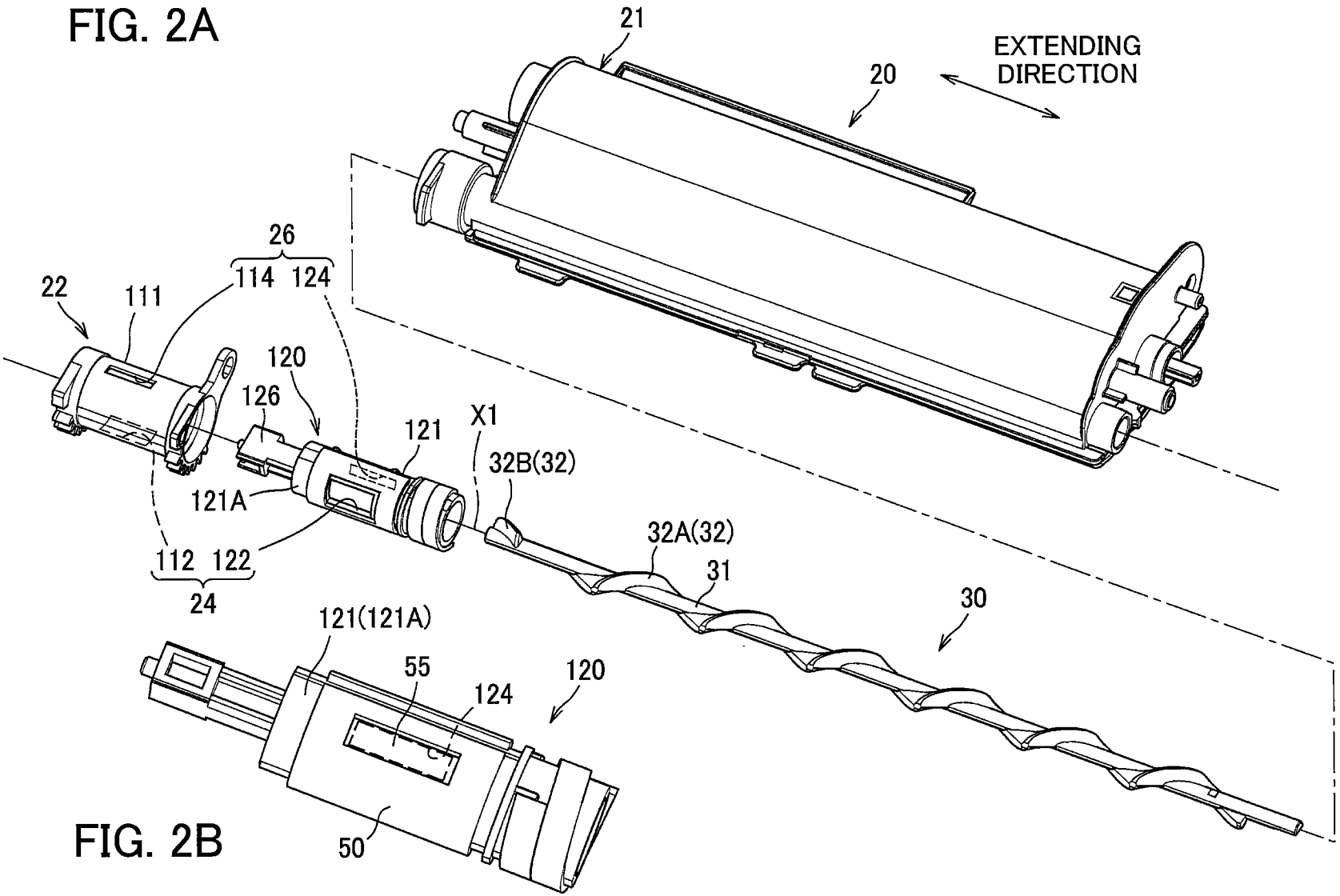
FIG. 2A is an exploded perspective view of the toner cartridge according to the first embodiment.
FIG. 2B is a perspective view of a shutter in the toner cartridge according to the first embodiment.

As illustrated in FIG. 2, the casing 20 includes a first casing 21 and a second casing 22. The first casing 21 extends in an extending direction which is along the rotation axis of the developing roller 12. The first casing 21 has a first internal space 21A (see FIGS. 1 and 3) capable of accommodating the toner T. Preferably, the extending direction is parallel to the rotation axis of the developing roller 12.

The second casing 22 is positioned at one end portion of the first casing 21 in the extending direction. The second casing 22 has a second internal space 22A (see FIG. 3) capable of accommodating the toner T. The second internal space 22A is connected to the first internal space 21A. The second internal space 22A is smaller than the first internal space 21A.

The auger screw 30 is positioned over the first internal space 21A and the second internal space 22A. The first agitator 40 is positioned in the first internal space 21A (see FIG. 1).

The auger screw 30 can convey the toner T accommodated in the first internal space 21A to the second internal space 22A. The auger screw 30 extends from the first internal space 21A to the second internal space 22A. The auger screw 30 is rotatable about a first rotation axis X1 extending in the extending direction. The auger screw 30 includes a shaft 31 and a helical plate 32.

The shaft 31 extends in the extending direction (i.e., the axial direction). The shaft 31 is rotatable about the first rotation axis X1.

The helical plate 32 has a helical shape. The helical plate 32 is rotatable together with the shaft 31. In accordance with rotation of the shaft 31, the helical plate 32 can convey the toner T in the extending direction from the first internal space 21A of the first casing 21 toward the second internal space 22A of the second casing 22.

The helical plate 32 includes a first helical plate 32A and a second helical plate 32B. The first helical plate 32A is positioned at one side (the first casing 21 side) of the casing 20 in the extending direction. As indicated by an arrow F1 in FIG. 3, the first helical plate 32A is configured to convey the toner T from one end of the casing 20 in the extending direction (one end of the first casing 21) toward the other end of the casing 20 in the extending direction (one end of the second casing 22).

The second helical plate 32B is positioned at the other side of the casing 20 in the extending direction. As indicated by an arrow F2 in FIG. 3, the second helical plate 32B is configured to convey the toner T from the other end of the casing 20 in the extending direction toward the first opening 112 (the toner discharge opening 24).

As illustrated in FIG. 1, the first agitator 40 is configured to agitate the toner T accommodated in the first internal space 21A of the first casing 21. The first agitator 40 includes a shaft 41 extending in the extending direction, and a blade 42. The blade 42 is positioned at an outer peripheral surface of the shaft 41 and extends in a radial direction of the shaft 41. The blade 42 is configured to rotate together with the shaft 41 and agitate the toner T accommodated in the first internal space 21A.

Figure 3:
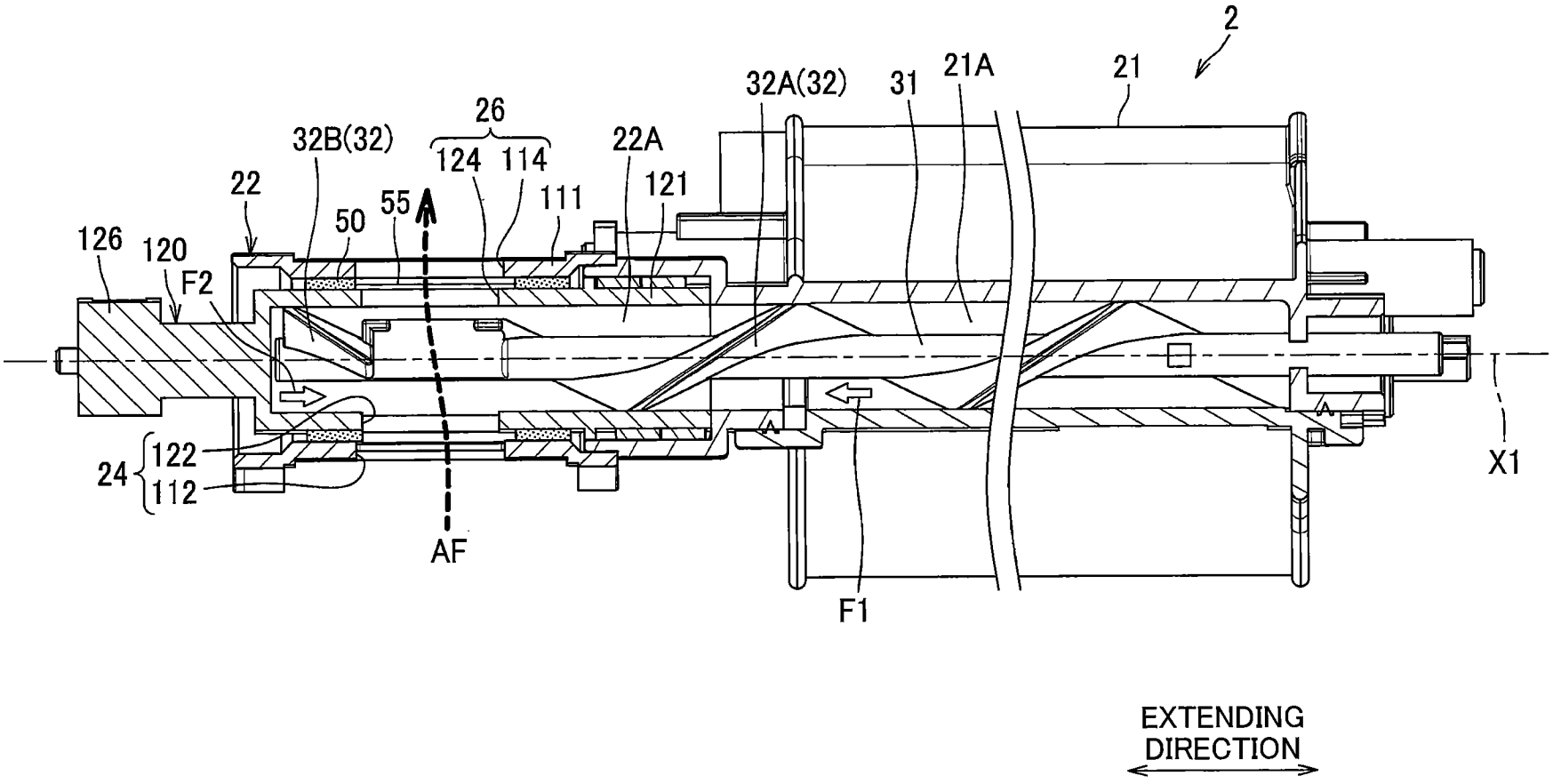
FIG. 3 is a cross-sectional view taken along line X-X in FIG. 1.

The second casing 22 and a shutter 120 rotatably positioned inside the second casing 22 will be described with reference to FIGS. 2 and 3.

The second casing 22 includes a first cylindrical portion 111. The first cylindrical portion 111 has a hollow cylindrical shape. The first cylindrical portion 111 has a first opening 112 constituting a part of the toner discharge opening 24. The toner discharge opening 24 is an opening for discharging the toner T in the second internal space 22A.

The first cylindrical portion 111 is further has a second opening 114 constituting a part of an air vent opening 26. The air vent opening 26 is an opening for sending air in the second internal space 22A to an outside of the second internal space 22A. The second opening 114 is positioned at a position facing the first opening 112 with the auger screw 30 interposed between the second opening 114 and the first opening 112. An opening area of the second opening 114 is smaller than an opening area of the first opening 112. For example, the opening area of the second opening 114 is approximately half as large as the opening area of the first opening 112. Specifically, the second opening 114 has a width in the extending direction which is equal to a width of the first opening 112 in the extending direction, and has a width in a circumferential direction which is half as wide as a width of the first opening 112 in the circumferential direction.

The shutter 120 is positioned at the one end portion of the first casing 21 in the extending direction. The shutter 120 includes a second cylindrical portion 121, an outer peripheral surface 121A, and a protrusion 126. The second cylindrical portion 121 has a hollow cylindrical shape.

The outer peripheral surface 121A is an outer peripheral surface of the second cylindrical portion 121. The second cylindrical portion 121 has a third opening 122 constituting a part of the toner discharge opening 24. The second cylindrical portion 121 further has a fourth opening 124 constituting a part of the air vent opening 26. The protrusion 126 extends from the second cylindrical portion 121 in the extending direction. The protrusion 126 is configured to engage with the casing 11 of the developing unit 1 when the toner cartridge 2 is attached to the developing unit 1.

The shutter 120 is positioned inside the second casing 22. The shutter 120 is rotatable relative to the second casing 22 about a second rotation axis extending in the extending direction. In the present embodiment, the second rotation axis is identical to the first rotation axis X1 of the auger screw 30.

Figure 4:
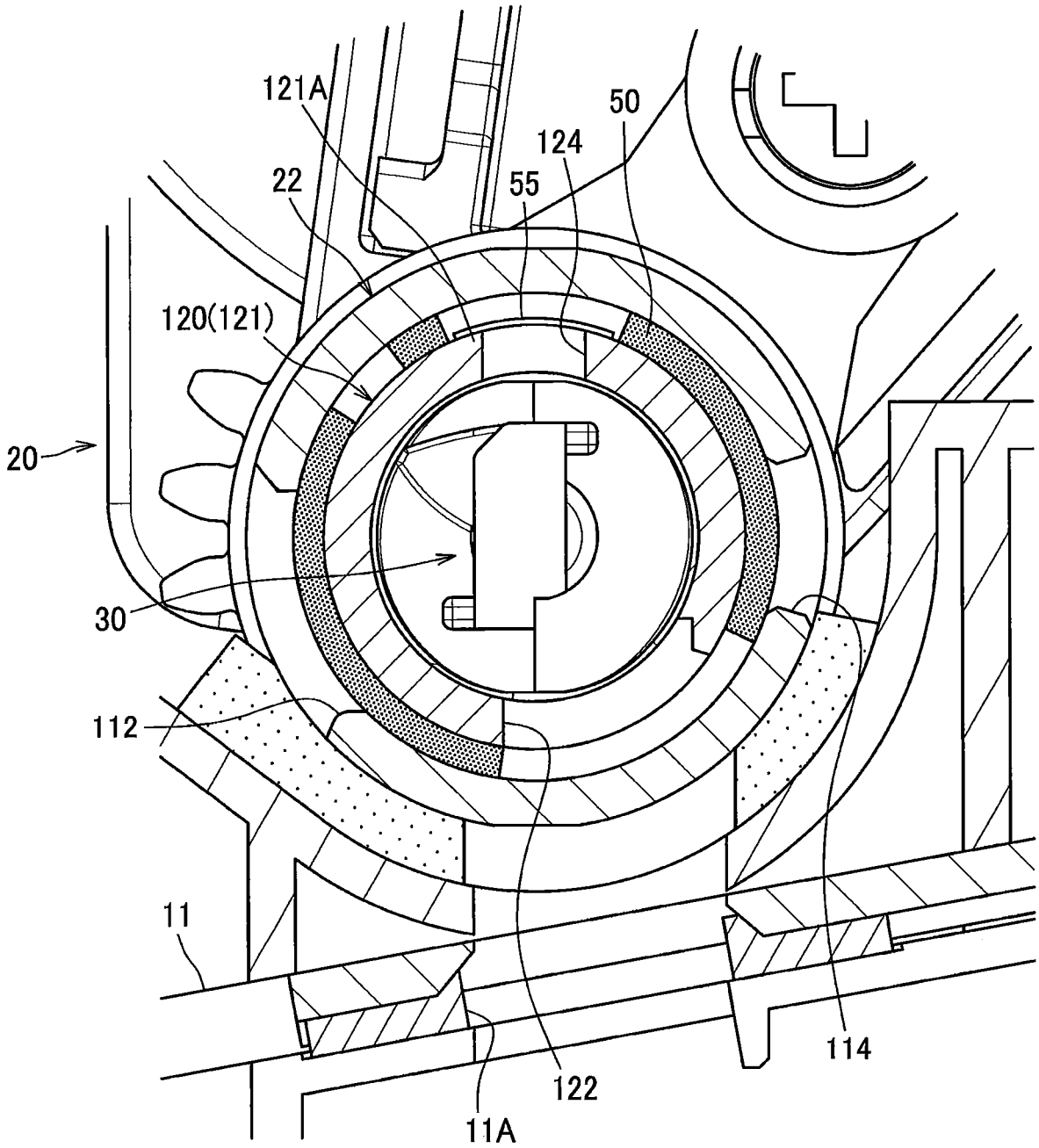
FIG. 4 is an enlarged view of FIG. 1 and illustrates a state where the shutter is at its first position.
Figure 5:
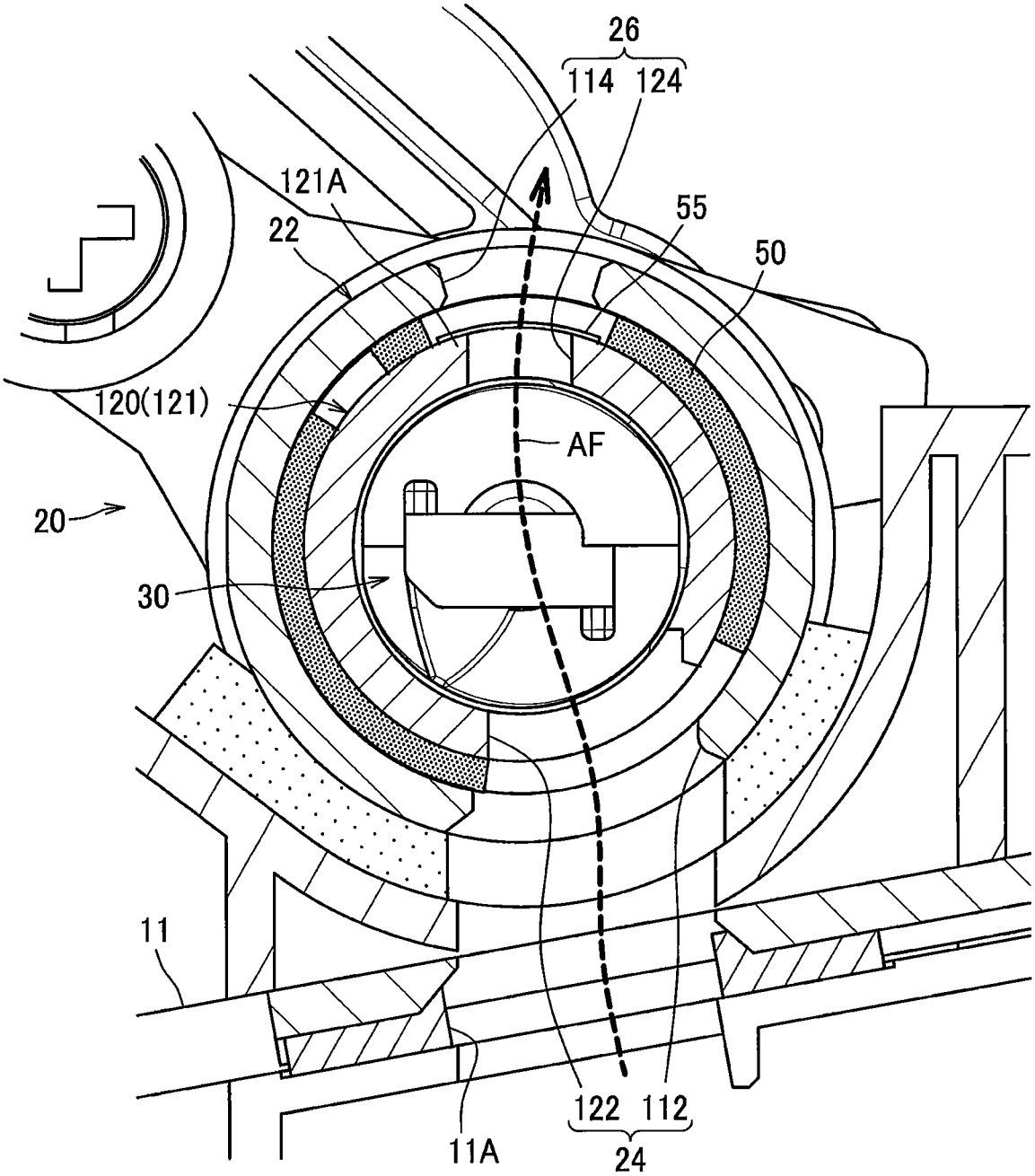
FIG. 5 is an enlarged view of FIG. 1 and illustrates a state where the shutter is at its second position.
Figure 6:
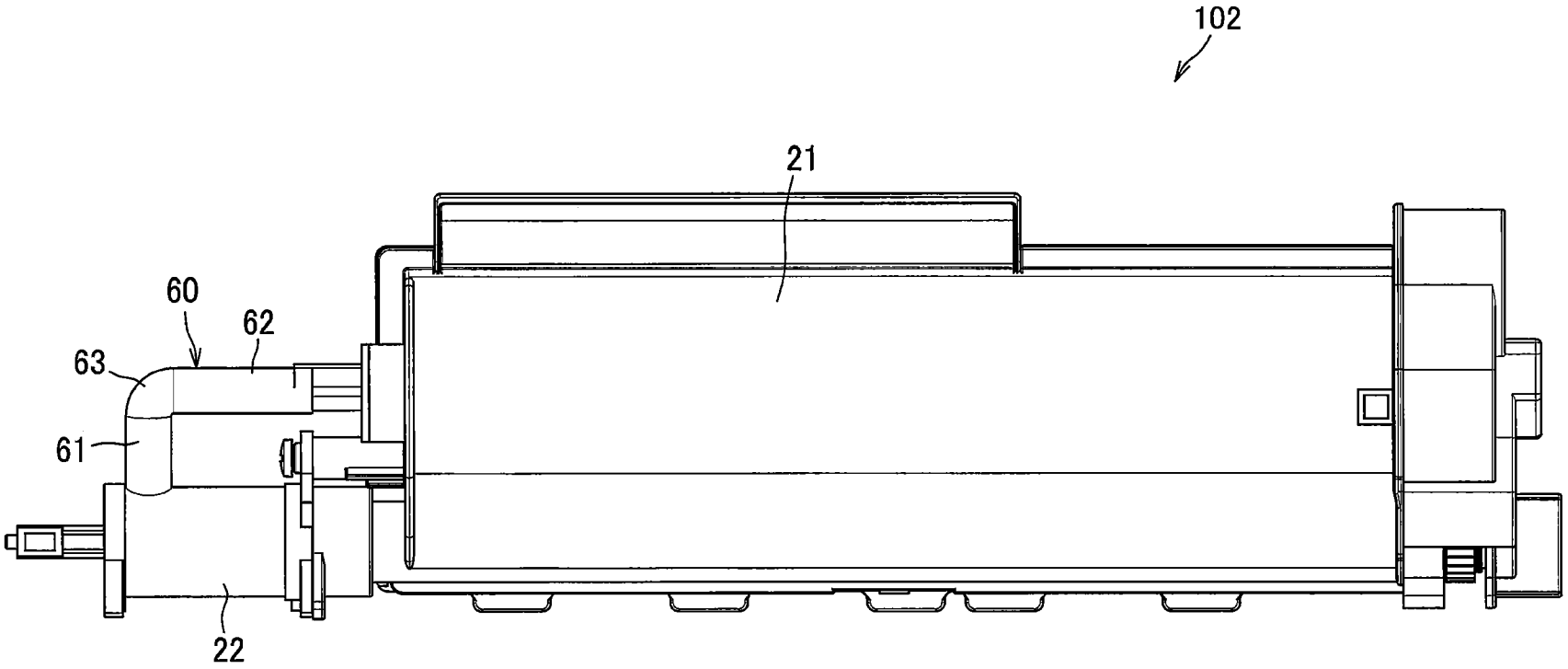
FIG. 6 is a plan view of a toner cartridge according to a second embodiment.

Specifically, the shutter 120 is rotatable between a first position (a closing position illustrated in FIG. 4) and a second position (an opening position illustrated in FIG. 5). In a state where the shutter 120 is at the first position, the third opening 122 is not overlapped with the first opening 112 and thus the shutter 120 closes the first opening 112. In a state where the shutter 120 is the second position, at least a part of the third opening 122 is overlapped with the first opening 112 and thus the shutter 120 opens the first opening 112.

In the state where the shutter 120 is at the first position, the toner discharge opening 24 is closed and thus the toner T is prevented from being discharged through the toner discharge opening 24. On the other hand, in the state where the shutter 120 is at the second position, the toner discharge opening 24 is opened and thus the toner T in the second internal space 22A can be discharged through the toner discharge opening 24.

Further, in the state where the shutter 120 is at the first position, the fourth opening 124 and the second opening 114 are not overlapped with each other and thus the second opening 114 is closed. On the other hand, in the state where the shutter 120 is at the second position, at least a part of the fourth opening 124 is overlapped with the second opening 114 and thus the second opening 114 is opened.

As illustrated in FIGS. 4 and 5, a sealing member 50 is stuck to the outer peripheral surface 121A of the shutter 120. The sealing member 50 is for suppressing toner leakage through a gap between the shutter 120 and the first opening 112 and toner leakage through a gap between the shutter 120 and the second opening 114. Of the sealing member 50, portions corresponding to the positions of the third opening 122 and the fourth opening 124 are cut away. The sealing member 50 is formed of a sponge rubber, for example.

A mesh film 55 is stuck to the outer peripheral surface 121A of the shutter 120 at a position covering the fourth opening 124. The mesh film 55 has a porous membrane structure allowing air to pass therethrough but preventing the toner T from passing therethrough. For example, product number S-NTF1026-N06, TEMISH (registered trademark), a product of NITTO DENKO Corporation, and product number EF-R-65, Elitolon (registered trademark) R-type, a product of TOYOBO CO., LTD. Can be used as the mesh film 55. A thickness of the mesh film 55 is smaller than a thickness of the sealing member 50. Therefore, the mesh film 55 does not contact an inner surface of the second casing 22 even when the shutter 120 rotates relative to the second casing 22.

Next, operations of the developing unit 1 and the toner cartridge 2 according to the present embodiment will be described. A user puts an unused toner cartridge 2 in the developing unit 1, so that the protruding 126 of the shutter 120 engages with the casing 11 of the developing unit 1 as illustrated in FIG. 4. By this engagement, rotational movement of the shutter 120 relative to the developing unit 1 is prevented.

In the state where the toner cartridge 2 is put in the developing unit 1, the shutter 120 is at the first position, the first opening 112 of the second casing 22 and the third opening 122 of the shutter 120 are not overlapped with each other, and the second opening 114 of the second casing 22 and the fourth opening 124 of the shutter 120 are not overlapped with each other. Hence, in this state, the toner discharge opening 24 and the air vent opening 26 remain closed.

Then, when the user rotates the toner cartridge 2 by a predetermined amount, the shutter 120 rotates relative to the second casing 22. As a result, as illustrated in FIG. 5, the shutter 120 rotates to the second position, so that the first opening 112 and the third opening 122 are overlapped with each other and thus the toner discharge opening 24 is opened. Hence, the toner T in the toner cartridge 2 can be supplied to the developing unit 1 through the toner discharge opening 24 (through the first opening 112). Further, the second opening 114 and the fourth opening 124 are overlapped with each other, so that the air vent opening 26 is opened. Incidentally, the shutter 120 may be configured to be opened and closed by direct user's manipulations to the shutter 120.

Then, when the auger screw 30 in the toner cartridge 2 is rotated, the toner T in the first internal space 21A is conveyed to the second internal space 22A and discharged into the developing unit 1 through the toner discharge opening 24 by the auger screw 30.

When the developing unit 1 is actuated, air is drawn into the developing unit 1 by rotation of the developing roller 12 and thus inner pressure of the developing unit 1 tries to increase. However, as indicated by an arrow AF in FIGS. 3 and 5, air in the developing unit 1 enters the second internal space 22A of the second casing 22 through the toner discharge opening 24 of the toner cartridge 2 and is then sent to an outside of the second casing 22 through the air vent opening 26.

With this structure, difference in inner pressure between the developing unit 1 and the toner cartridge 2 is less likely to occur. Accordingly, even when the developing unit 1 operates in a long time, the occurrence of difference in inner pressure between the developing unit 1 and the toner cartridge 2 can be suppressed. Consequently, the toner T can be smoothly discharged from the toner cartridge 2 to the developing unit 1 through the toner discharge opening 24.

According to the first embodiment, the following advantages can be obtained. Since the second opening 114 through which air in the second internal space 22A of the second casing 22 can be released to an outside is provided, inner pressure of the developing unit 1 can be decreased through the second opening 114. Hence, smooth discharge of toner through the first opening 112 of the casing 22 can be performed.

In a case where the toner cartridge 2 is in an unused state, the first opening 112 and the second opening 114 of the second casing 22 are closed by the shutter 120. Hence, the toner T in the second internal space 22A of the second casing 22 can be suppressed from leaking.

Since the fourth opening 124 is covered by the mesh film 55 which allows air to pass therethrough but prevents the toner T from passing therethrough, air can be released from the second casing 22 to the outside while suppressing toner leakage from the second casing 22. Accordingly, increase in inner pressure of the developing unit 1 can be suppressed, thereby enabling the toner T to be smoothly discharged through the first opening 112.

Since the sealing member 50 having the thickness greater than the thickness of the mesh film 55 is stuck to the outer peripheral surface 121A of the shutter 120, the sealing member 50 frictionally contacts the first cylindrical portion 111 of the second casing 22 at a position between the inner peripheral surface of the second casing 22 and the outer peripheral surface 121A of the shutter 120. With this structure, toner leakage can be suppressed. Further, since the mesh film 55 does not contact the inner peripheral surface of the second casing 22, frictional wearing of the mesh film 55 can be suppressed.

Next, a toner cartridge 102 according to a second embodiment will be described with reference to FIGS. 6 to 9, wherein like parts and components are designated by the same reference numerals as those shown in the above-described embodiment to avoid duplicating description.

The toner cartridge 102 includes a pipe 60 connecting the second internal space 22A of the second casing 22 and the first internal space 21A of the first casing 21 through the second opening 114. The pipe 60 forms a passage for releasing air in the second casing 22 into the first internal space 21A of the first casing 21.

Figure 9:
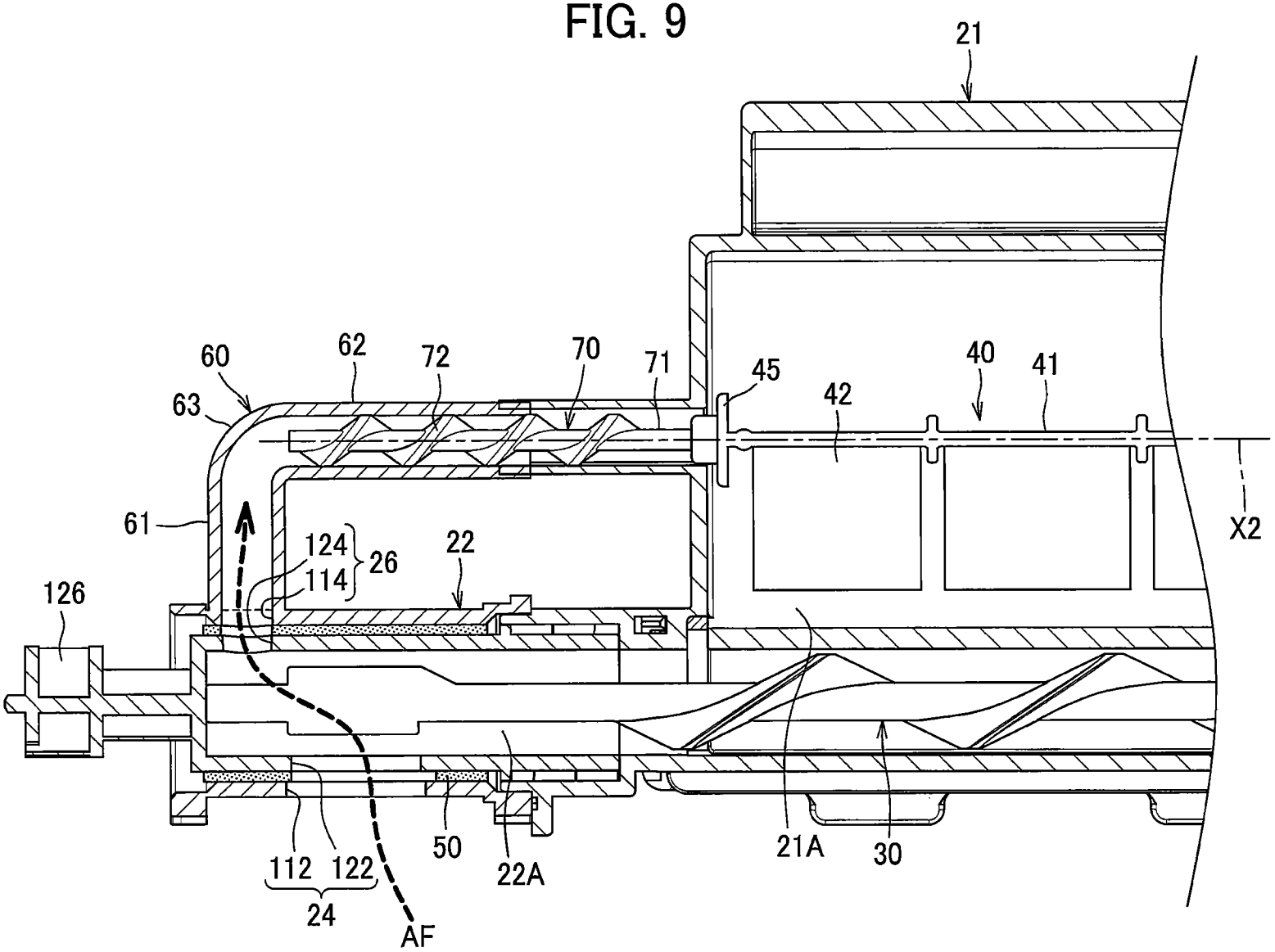
FIG. 9 is a cross-sectional view taken along line Y-Y in FIG. 8.

Specifically, the pipe 60 includes a first pipe portion 61, a second pipe portion 62, and a third pipe portion 63 connecting the first pipe portion 61 and the second pipe portion 62. As illustrated in FIG. 9, the first pipe portion 61 is in communication with the second opening 114 and extends from the second casing 22 in a direction perpendicular to the extending direction. The second pipe portion 62 is in communication with the first internal space 21A of the first casing 21. The second pipe portion 62 extends from the first casing 21 in the extending direction on an extension of the shaft 41 of the first agitator 40. The third pipe portion 63 has a curved shape connecting one end portion of the first pipe portion 61 and one end portion of the second pipe portion 62.

Figure 7:
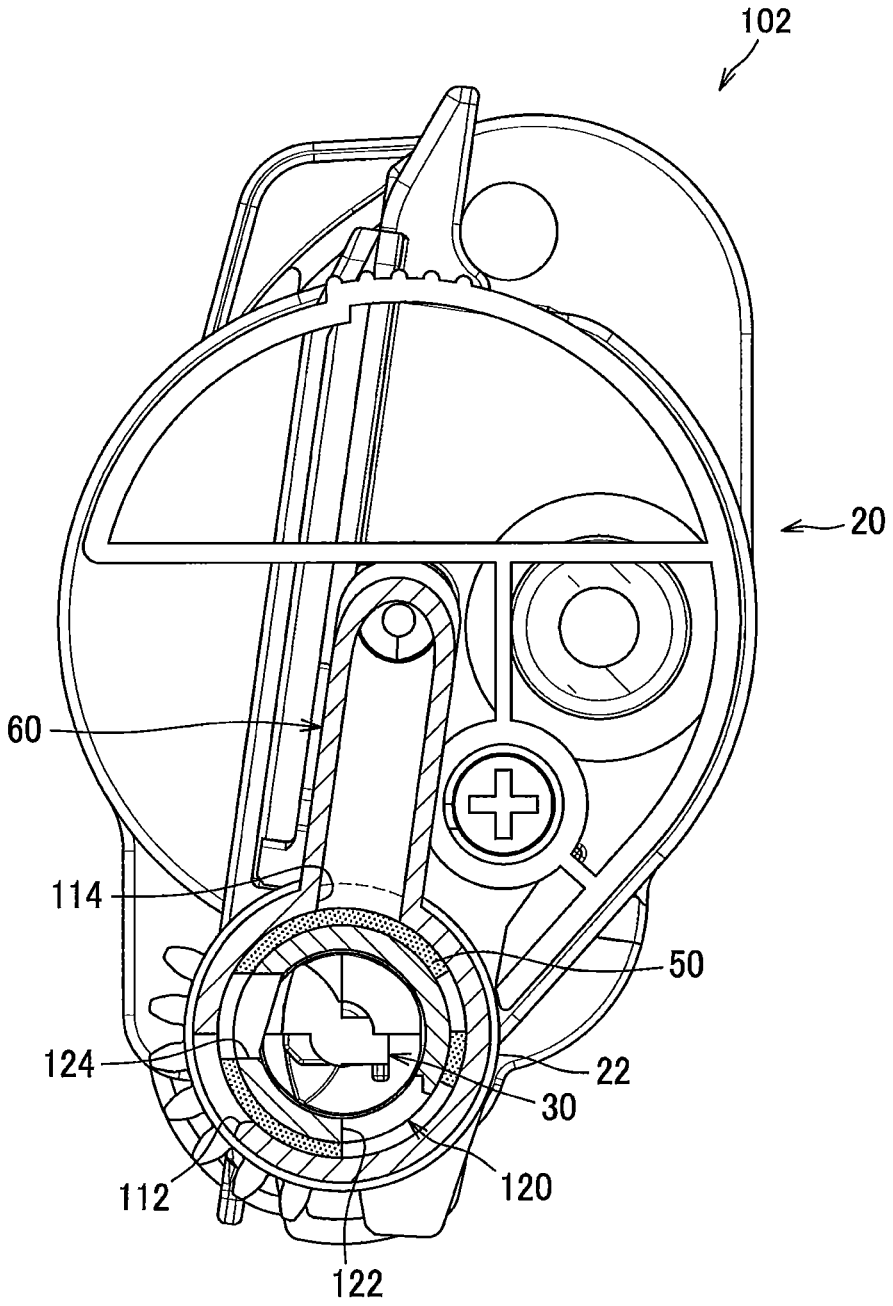
FIG. 7 is a cross-sectional view illustrating a state where a shutter is at its first position in the toner cartridge according to the second embodiment.
Figure 8:
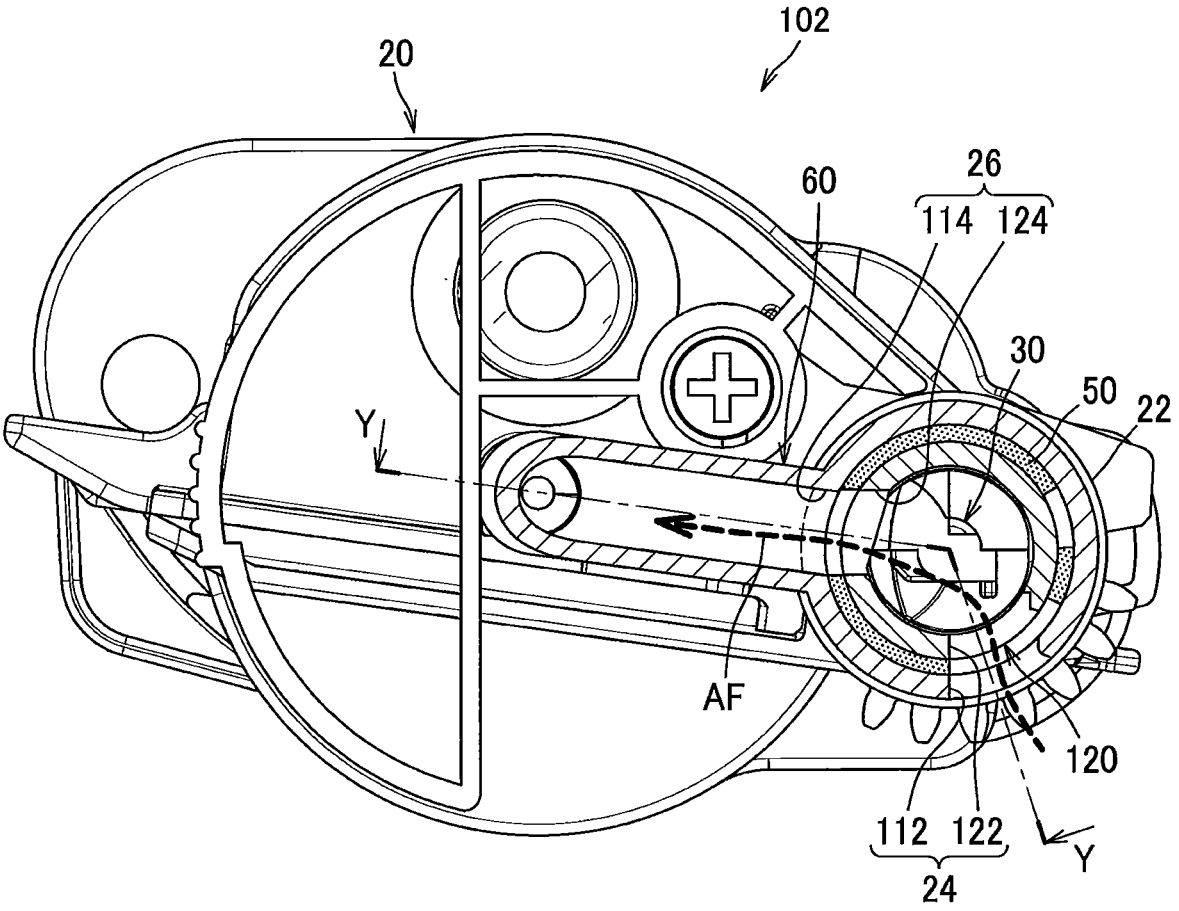
FIG. 8 is a cross-sectional view illustrating a state where the shutter is at its second position in the toner cartridge according to the second embodiment.

As illustrated in FIGS. 7 and 8, the second casing 22 has the first opening 112 and the second opening 114. The shutter 120 has the third opening 122 and the fourth opening 124 and includes the protrusion 126 (see FIG. 9). The sealing member 50 is stuck to the outer peripheral surface of the shutter 120 but the mesh film covering the fourth opening 124 is not stuck.

As illustrated in FIG. 9, a second auger screw 70 is positioned in the second pipe portion 62. The second auger screw 70 is configured to convey the toner T in the pipe 60 toward the first internal space 21A.

Specifically, a flange portion 45 is provided at one end of the shaft 41 of the first agitator 40. The second auger screw 70 extends from the flange portion 45 in the extending direction. The flange 45 is for suppressing the toner T from entering the pipe 60.

The second auger screw 70 is configured to rotate together with the first agitator 40 in the pipe 60. The second auger screw 70 includes a shaft 71 and a helical plate 72.

The shaft 71 is fixed to the flange portion 45 of the first agitator 40. The shaft 71 extends in the extending direction on the extension of the shaft 41. The shaft 71 is configured to rotate integrally with the first agitator 40 in accordance with rotation of the first agitator 40. The shaft 71 and the shaft 41 are rotatable about a rotation axis X2 extending in the extending direction.

The helical plate 72 has a helical shape. The helical plate 72 is rotatable together with the shaft 71. In accordance with rotation of the shaft 71, the helical plate 72 can convey the toner T in the extending direction toward the first internal space 21A from the one end portion of the second pipe portion 62, which is closer to the third pipe portion 63 than the other end portion of the second pipe portion 62 is to the third pipe portion 63.

In a case where the toner cartridge 102 is in an unused state, the shutter 120 is positioned at the first position and thus closes the first opening 112 and the second opening 114 as illustrated in FIG. 7. When a user puts the toner cartridge 102 in the developing unit 1 and rotates the toner cartridge 102 relative to the developing unit 1 by a predetermined amount, the shutter 120 rotates to the second position as illustrated in FIG. 8, so that the first opening 112 and the third opening 122 are overlapped with each other and thus the toner discharge opening 24 is opened. As a result, the toner T in the toner cartridge 102 can be supplied to the developing unit 1 through the toner discharge opening 24 (the first opening 112). Further, the second opening 114 and the fourth opening 124 are overlapped with each other and thus the air vent opening 26 is opened.

Then, when the auger screw 30 in the toner cartridge 102 is rotated, the toner T in the first internal space 21A is conveyed to the second internal space 22A and discharged into the developing unit 1 through the toner discharge opening 24 by the auger screw 30.

When the developing unit 1 is actuated, air is drawn into the developing unit 1 by rotation of the developing roller 12 and thus inner pressure of the developing unit 1 tries to increase. However, as indicated by an arrow AF in FIGS. 8 and 9, air in the developing unit 1 enters the second internal space 22A of the second casing 22 through the toner discharge opening 24 of the toner cartridge 102 and flows into the pipe 60 through the air vent opening 26. Then, the air flows from the pipe 60 into the first internal space 21A of the first casing 21.

With this structure, difference in inner pressure between the developing unit 1 and the toner cartridge 102 is less likely to occur. Accordingly, even when the developing unit 1 operates in a long time, the toner T can be smoothly discharged from the toner cartridge 102 to the developing unit 1 through the toner discharge opening 24.

Incidentally, the toner T enters the pipe 60 since the second internal space 22A of the second casing 22 and the first internal space 21A of the first casing 21 are connected to each other by the pipe 60. However, the toner T can be returned back to the first internal space 21A by the second auger screw 70 provided in the second pipe portion 62, thereby ensuring flow of air in the pipe 60.

In the toner cartridge 102 according the second embodiment described above, the pipe 60 connecting the first casing 21 and the second casing 22 through the second opening 114 is provided. Hence, instead of releasing air in the second internal space 22A of the second casing 22 into the outside of the second casing 22, air in the second internal space 22A can be released from the second opening 114 through the pipe 60 into the first internal space 21A of the first casing 21. Accordingly, inner pressure of the developing unit 1 can be decreased, thereby enabling toner to be smoothly discharged from the second casing 22 through the first opening 112.

In the above-described second embodiment, since the second auger screw 70 configured to rotate together with the first agitator 40 in the pipe 60 is provided, the toner T which has entered the pipe 60 can be returned back to the first internal space 21A of the first casing 21. Hence, air flowing from the second opening 114 through the pipe 60 can be smoothly released into the first internal space 21A of the first casing 21.

While the description has been made in detail with reference to the specific embodiments, it would be apparent to those skilled in the art that many modifications and variations may be made thereto. In the following description, various modifications will be described while focusing on differences between each modification and the above-described embodiments.

For example, in the toner cartridge 2 according to the first embodiment, instead of provision of the mesh film 55 which is stuck to the outer peripheral surface 121A of the shutter 120 and covers the fourth opening 124, a mesh film may be provided which is stuck to an outer peripheral surface of the second casing 22 and covers the second opening 114. Further, in the toner cartridge 102 according to the second embodiment, a mesh film may be stuck to the outer peripheral surface of the shutter 120 so as to cover the fourth opening 124.

Furthermore, in the toner cartridge 102 according to the second embodiment, the second opening 114 of the second casing 22 need not necessarily be closed in the state where the shutter 120 is at the first position. Specifically, the third opening 122 and the fourth opening 124 may be connected by cutting away a part of the outer peripheral surface 121A of the shutter 120 illustrated in FIG. 2.

Moreover, in both the toner cartridge 2 according to the first embodiment and the toner cartridge 102 according to the second embodiment, a configuration may be employed in which opening and closing of the toner discharge opening

24 is performed by rotating the shutter 120 in a state where the second casing 22 is fixed relative to the developing unit 1.

In the above-described embodiments, the toner discharge openings 24 of each of the toner cartridges 2 and 102 is positioned at an end portion in the extending direction. However, the toner discharge opening may be positioned at the center or near the center in the extending direction.

Further, implementation can be performed with any combination of the components employed in the above-described embodiments and modifications.

What is claimed is:

1. A toner cartridge comprising:

a casing extending in an extending direction, the casing having:

an internal space capable of accommodating toner; and a first opening allowing toner in the internal space to be discharged;

a conveyor configured to convey toner in the internal space, the conveyor being rotatable about a first rotation axis extending in the extending direction; and a shutter positioned at the first opening, the shutter being rotatable relative to the casing about a second rotation axis between a first position in which the shutter closes the first opening and a second position in which the shutter opens the first opening, the second rotation axis extending in the extending direction, wherein the casing further has a second opening allowing air in the internal space to be sent to an outside of the casing, the second opening facing the first opening, and wherein, in a state where the shutter is at the second position, the shutter does not close the second opening.

2. The toner cartridge according to claim 1, wherein, in a state where the shutter is at the first position, the shutter closes the second opening.

3. The toner cartridge according to claim 1, wherein the shutter is positioned inside the casing and has a third opening and a fourth opening, wherein, in a state where the shutter is at the first position, the third opening is not overlapped with the first opening and the fourth opening is not overlapped with the second opening, and wherein, in a state where the shutter is at the second position, at least a part of the third opening is overlapped with the first opening and at least a part of the fourth opening is overlapped with the second opening.

4. The toner cartridge according to claim 3, further comprising a mesh film covering the fourth opening, the mesh film allowing air to pass therethrough but preventing toner from passing therethrough.

5. The toner cartridge according to claim 4, further comprising a seal member for suppressing toner leakage through a gap between the shutter and the second opening, the seal member being stuck to an outer peripheral surface of the shutter, wherein a thickness of the seal member is greater than a thickness of the mesh film.

6. The toner cartridge according to claim 1, further comprising a mesh film covering the second opening, the mesh film allowing air to pass therethrough but preventing toner from passing therethrough.

7. The toner cartridge according to claim 1, wherein the conveyor is positioned between the first opening and the second opening.

8. The toner cartridge according to claim 1, wherein the second opening faces the first opening in a radial direction of the first rotation axis.

9. The toner cartridge according to claim 1, wherein the conveyor is an auger screw.

* * * * *